US007299830B2

(12) United States Patent
Levin et al.

(10) Patent No.: US 7,299,830 B2
(45) Date of Patent: Nov. 27, 2007

(54) LOW TENSION FLUSH CUT-OFF CABLE TIE INSTALLATION TOOL

(75) Inventors: Robert F. Levin, Braceville, IL (US); Lawrence A. Hillegonds, New Lenox, IL (US)

(73) Assignee: Panduit Corp., Tinley Park, IL (US)

( * ) Notice: Subject to any disclaimer, the term of this patent is extended or adjusted under 35 U.S.C. 154(b) by 55 days.

(21) Appl. No.: 11/143,073

(22) Filed: Jun. 2, 2005

(65) Prior Publication Data

US 2005/0268983 A1 Dec. 8, 2005

Related U.S. Application Data

(60) Provisional application No. 60/577,118, filed on Jun. 4, 2004.

(51) Int. Cl.
*B21F 9/00* (2006.01)

(52) U.S. Cl. ..... 140/123.6; 140/93.2

(58) Field of Classification Search ..... 140/93.2, 140/123.6

See application file for complete search history.

(56) References Cited

U.S. PATENT DOCUMENTS 3,712,346 A * 1/1973 Noorily ..... 140/123.6
4,202,384 A 5/1980 Aubert
4,321,952 A 3/1982 Natkins
4,410,019 A 10/1983 Suzuki
5,492,156 A 2/1996 Dyer et al.
5,832,964 A 11/1998 Joshi
5,915,425 A 6/1999 Nilsson et al.
5,921,290 A 7/1999 Dyer et al.
6,206,053 B1 3/2001 Hillegonds

FOREIGN PATENT DOCUMENTS

GB 2 377 070 A 12/2002
GB 2 379 749 A 3/2003

* cited by examiner

*Primary Examiner*—Ed Tolan
(74) *Attorney, Agent, or Firm*—Robert A. McCann; Christopher S. Clanc; Aimee E. McVady

(57) ABSTRACT

A cable tie installation tool tensions a cable tie about a plurality of elongated objects and severs an excess portion of the cable tie. The cable tie includes a head portion and a tail portion. The tool includes a housing having a blade guard having a front portion and an anvil portion, a tensioning mechanism operatively supported by the housing for tensioning the cable tie to a predetermined tension setting and retaining the cable tie head portion at least partially against the blade guard, and a severing mechanism including a linearly reciprocating blade for severing the excess portion of the cable tie near the head portion once the cable tie has been placed into the predetermined tension setting by the tensioning mechanism. The linearly reciprocating blade passes behind the front portion of the blade guard and in front of the anvil portion of the blade guard.

8 Claims, 9 Drawing Sheets

LOW TENSION FLUSH CUT-OFF CABLE TIE INSTALLATION TOOL

CROSS-REFERENCE TO RELATED APPLICATION

This application claims priority to and incorporates by reference in its entirety U.S. Provisional Application Ser. No. 60/577,118, entitled "Low Tension Flush Cut-Off Cable Tie Installation Tool," filed on Jun. 4, 2004.

BACKGROUND OF THE INVENTION

Most cable tie application tools apply a predetermined tension to a cable tie encircled about a number of loose objects before cutting away an excess portion of the cable tie tail. As it is desirable to not have the cut edge of the tie, which is often sharp, protrude from the head, thereby posing a danger to people and nearby objects, the tails are generally cut fairly close to the head such that the tension in the applied cable tie will cause the sharp edge of the tail to recede into the cable tie head. When this occurs, a desirable "flush" cut-off has occurred.

While many cable tie applications require the tie to tightly bind the loose objects, there are also some important low-tension applications, such as where high tension might cause damage to the bundled objects. For example, it is sometimes important that cable ties not be applied so tightly so as to deform a cable sheath, as in the case of bundling twisted pair copper wires. Sometimes it may be desirable to slide an applied cable tie along the length of a cable bundle, such ability requiring a more loosely applied cable tie. Though application tools exist wherein one can lower the predetermined tension to an acceptable level for such applications, the lower degree of tension stored in the cable ties often provides insufficient spring-back ability to cause the cut edge of the tail to recede back into the head, thereby leaving a sharp protruding edge.

SUMMARY OF THE INVENTION

To address shortcomings of prior tools and provide performance advantages relative to prior tools, there is provided a cable tie application tool that provides for flush cutoffs in low tension cable tie applications. Specifically, the inventive tool has a special design that permits a tail cutoff point that is closer to the head than in prior designs such that the lower spring-back power of the low-tension applications is sufficient to cause the cut end of the tail to recede into the head of the tie.

In one embodiment of the invention, there is provided a cable tie installation tool for tensioning a cable tie about a plurality of elongated objects and severing an excess portion of the cable tie. The cable tie includes a head portion and a tail portion. The tool includes a housing blade guard having a front portion and an anvil portion, a tensioning mechanism operatively supported by the housing for tensioning the cable tie to a predetermined tension setting and retaining the cable tie head portion at least partially against the blade guard, and a severing mechanism including a linearly reciprocating blade for severing the excess portion of the cable tie near the head portion once the cable tie has been placed into the predetermined tension setting by the tensioning mechanism. The linearly reciprocating blade passes behind the front portion of the blade guard and in front of the anvil portion of the blade guard.

In another embodiment of the invention, there is provided a cable tie installation tool for tensioning a cable tie about a plurality of elongated objects and severing an excess portion of the cable tie. The cable tie includes a head portion and a tail portion. The tool includes a housing having a blade guard having a front portion and an anvil portion, a tensioning mechanism operatively supported by the housing for tensioning the cable tie to a predetermined tension setting and retaining the cable tie head portion at least partially against the blade guard, and a severing mechanism including a linearly reciprocating blade for severing the excess portion of the cable tie near the head portion once the cable tie has been placed into the predetermined tension setting by the tensioning mechanism. The front portion of the blade guard includes a recessed portion having a spacer portion no more than approximately 0.030±0.010 inches thick.

In yet another embodiment of the invention, there is a provided a blade guard for a cable tie installation tool for tensioning a cable tie about a plurality of elongated objects and severing an excess portion of the cable tie. The cable tie includes a head portion and a tail portion. The blade guard includes a front portion, a recessed portion on the front portion, and an anvil portion having a front end for contacting the cable tie head portion during at least one of the tensioning and the severing. The front end of the anvil portion is generally disposed behind the recessed portion of the front portion.

DETAILED DESCRIPTION OF PREFERRED EMBODIMENTS

The general design of the illustrated embodiment of the claimed cable tie application tool is similar to the design(s) shown in U.S. Pat. No. 6,206,053 to Hillegonds, the full disclosure and teaching of that patent being incorporated herein by reference. Aspects of the presently described tool may be configured identically or nearly identically to the design(s) shown in the '053 patent. It is preferred that tensioning mechanisms according to the present invention have lower tension settings, with potentially finer gradations between adjacent tension settings.

As described above, the lesser snap-back of cable ties applied and severed at lower tensions means that a tie tail must be severed closer to the tie head to ensure that the potentially sharp severed edge of the tie tail recedes into the head so that it doesn't protrude and pose a danger to people or nearby objects. The claimed and described tool achieves a closer severance point by relieving the blade guard anvil and/or by increasing the recess depth of the blade guard (or decreasing the thickness of the spacer wall) so that the tie head can be pulled closer to the cut line of the blade before severance. Additionally, using cable ties having cooperatively configured heads, such as are found in some low-profile and in-line ties, may, especially in cooperation with the increased recess depth of the blade guard and/or relieved anvil, yields particularly desirable proximity between the severance point of the tie tail and the point the tail exits the cable tie head, so as to limit the required snap-back travel distance for the severed edge of the tail to recede into the head.

Of course, it is also important to avoid too much snap-back to avoid the tail slipping back through the portion of the head that retains the tail. When the teeth of the cable tie tail insufficiently engage the complementary teeth of the cable tie head, this can result in complete failure or decreased loop tensile strength of the cable tie. Thus, it is important to coordinate the tension and snap-back distance with the properties of the blade guard that determine how closely to the head a cable tie tail is cut. For example, in some embodiments the spacer portion of the blade guard assures a minimum snap-back distance before tie failure.

Figure 1:
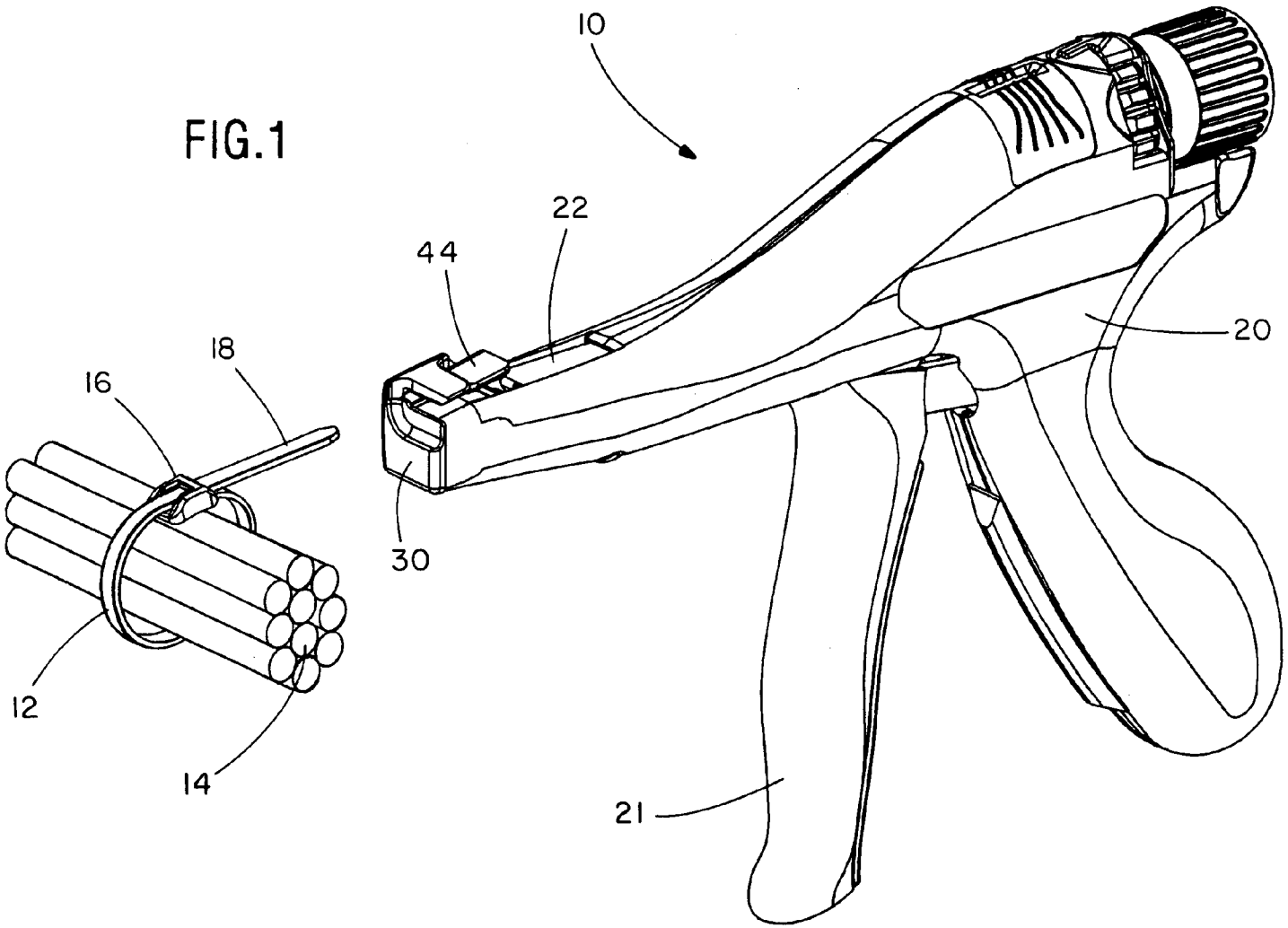
FIG. 1 is a front upper right perspective view of a tool in accordance with an embodiment of the invention.
Figure 3:
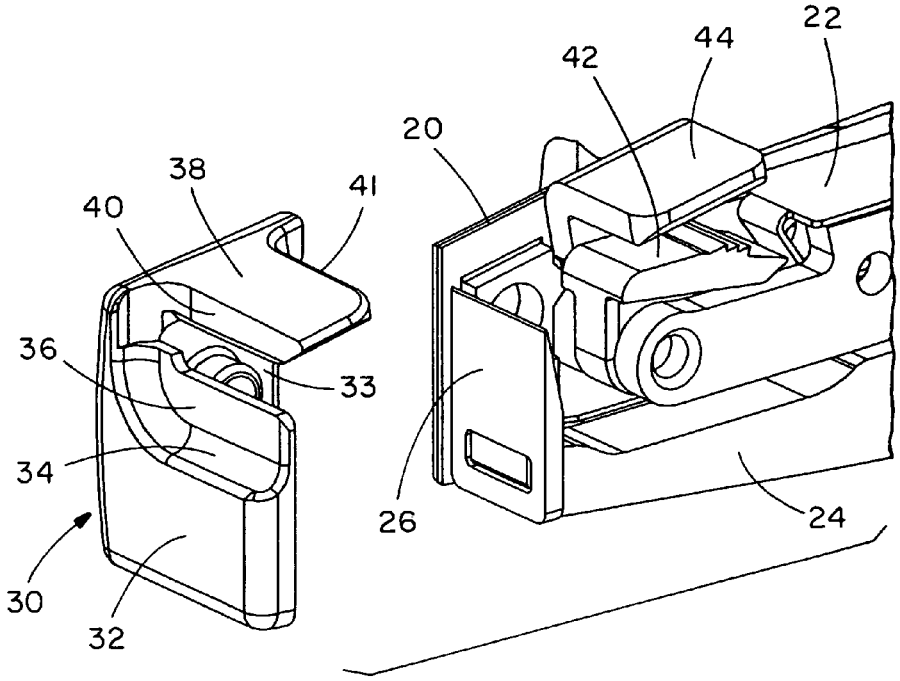
FIG. 3 is a view akin to that of FIG. 2 wherein a portion of the housing is removed and the blade guard is exploded to facilitate the viewing of interior parts.
Figure 5:
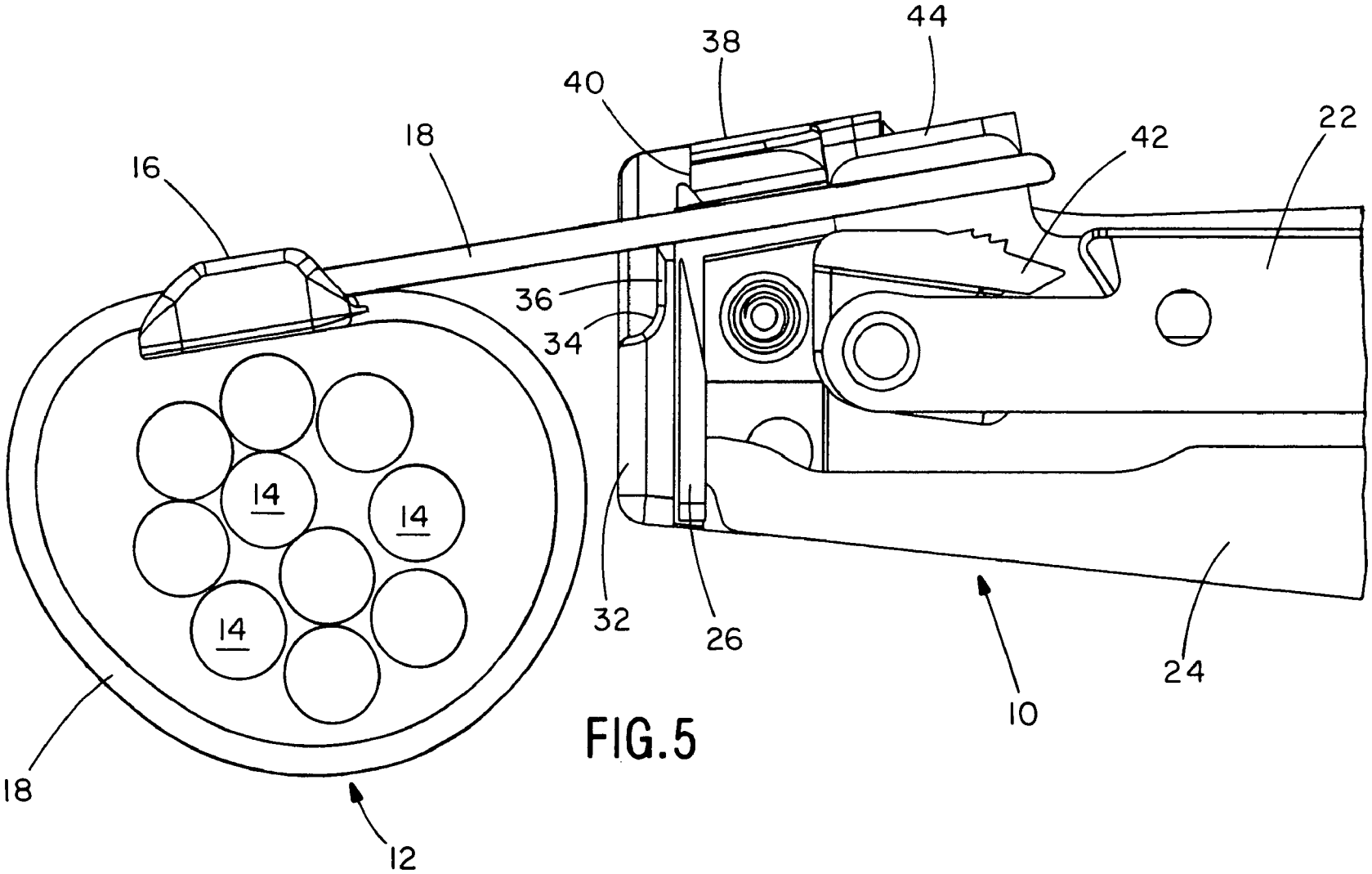
FIG. 5 is a right side plan view of a front portion of the tool of FIG. 1 wherein a portion of the housing is removed to facilitate the viewing of interior parts and the tail portion of the cable tie has been inserted into the tool.

The cable tie installation tool 10, shown generally in FIG. 1, is used to tension a cable tie 12 around one or more objects, such as elongated objects 14, to bundle the objects together and/or facilitate mounting or routing the objects. For example, a bundle of electrical wires or fiber optic cords may be bundled together to facilitate the handling and routing of the wires or cords. As seen in detail in FIG. 8, the cable tie 12 generally includes a head portion 16 having teeth 28 inset in a passageway 17 therethrough and a tail portion 18 having complementary teeth 29 thereon for interacting with the teeth 28 set in the head 16 to prevent the tail from excessively reversing through the passageway 17. The tool 10 may include a housing 20 (FIG. 1) that holds together an actuation mechanism 21, a gripping and tensioning mechanism 22, and a severance mechanism 24 having a blade 26 (FIGS. 3 and 5). Other than the differences described herein, especially with regard to severance point location, these mechanisms preferably cooperate to apply, through tensioning and severing, cable ties around objects in a manner similar or identical to that shown in the '053 patent.

Figure 2:
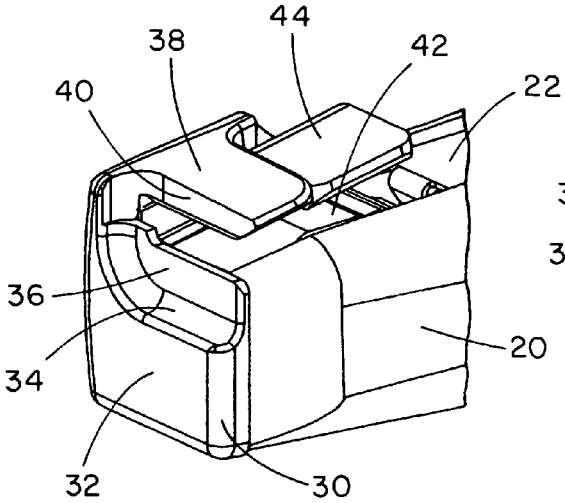
FIG. 2 is an enlarged front upper right perspective view of the broken-away frontmost portion of the tool of FIG. 1.
Figure 4:
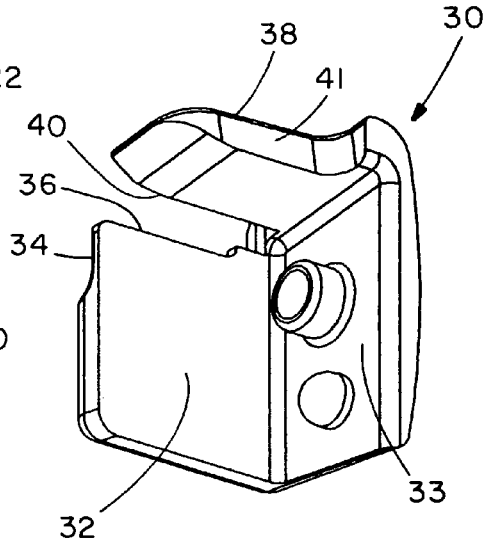
FIG. 4 is a rear lower right perspective view of the blade guard.

FIGS. 2-4 highlight a preferred embodiment of the inventive blade guard. The blade guard 30, disposed at the front of the tool 10 and adjoining the housing 20, has a front portion 32 having a recessed portion 34 thereon, and a side portion 33. In a preferred embodiment, the recessed portion 34 includes at its most recessed area a spacer portion 36. The blade guard 30 also includes an anvil portion 38, that preferably extends perpendicularly from the side portion 33, having a front edge 40 and a rear edge 41.

The anvil portion 38 may serve to limit the forward travel of the tensioning assembly 22, such as when the pressure plate 44 contacts the rear edge 41 of the anvil portion 38. In prior blade guards, such as one shown in the '053 patent, the anvil included a slot for receiving the cuffing edge of a blade (not numbered, but observable in FIG. 15 of the '053 patent). In the present design, however, the anvil portion 38 is preferably relieved from the front portion 32 to permit the cutting blade 26 to pass between them, i.e., behind the front portion 32, but in front of at least part of the anvil portion 38. If it is desired that the rear edge 41 of the anvil portion remain in the same place as in prior designs so that it may maintain its function of limiting forward travel of the tensioning assembly 22, then the anvil may simply be made smaller so that the front edge 40 is relieved from the front portion 32 while the rear edge 41 is not displaced.

Figure 6:
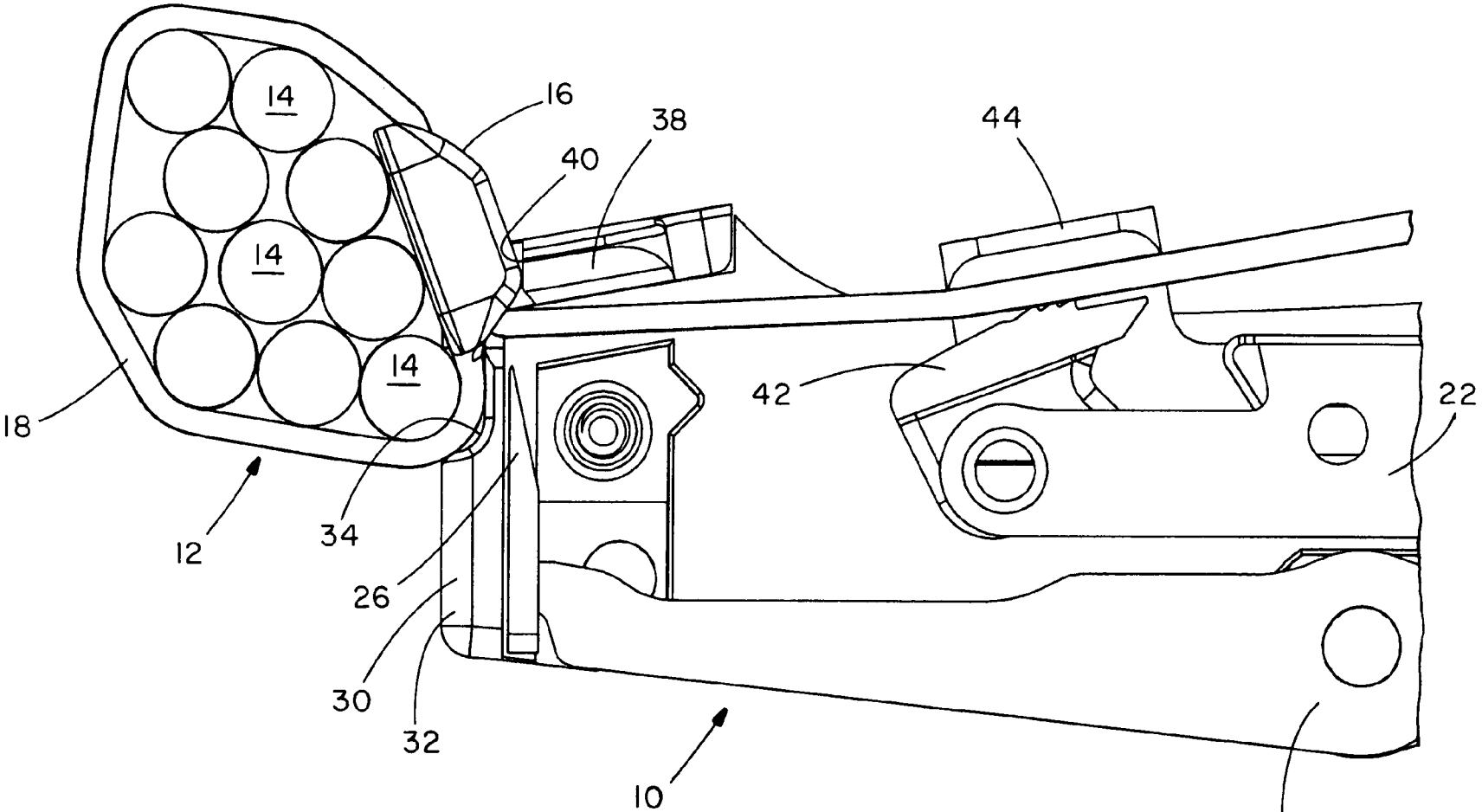
FIG. 6 is a view akin to that of FIG. 5 wherein the tool has engaged the tie tail and tensioned the tie around the bundle of elongated objects.
Figure 7:
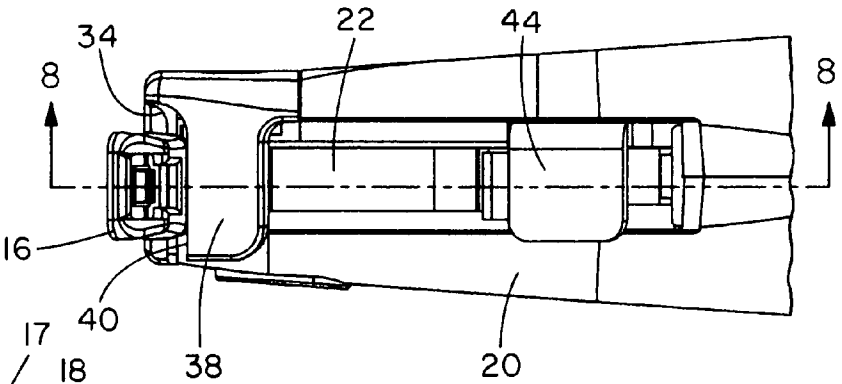
FIG. 7 is top plan view of a front portion of the tool of FIG. 1.
Figure 8:
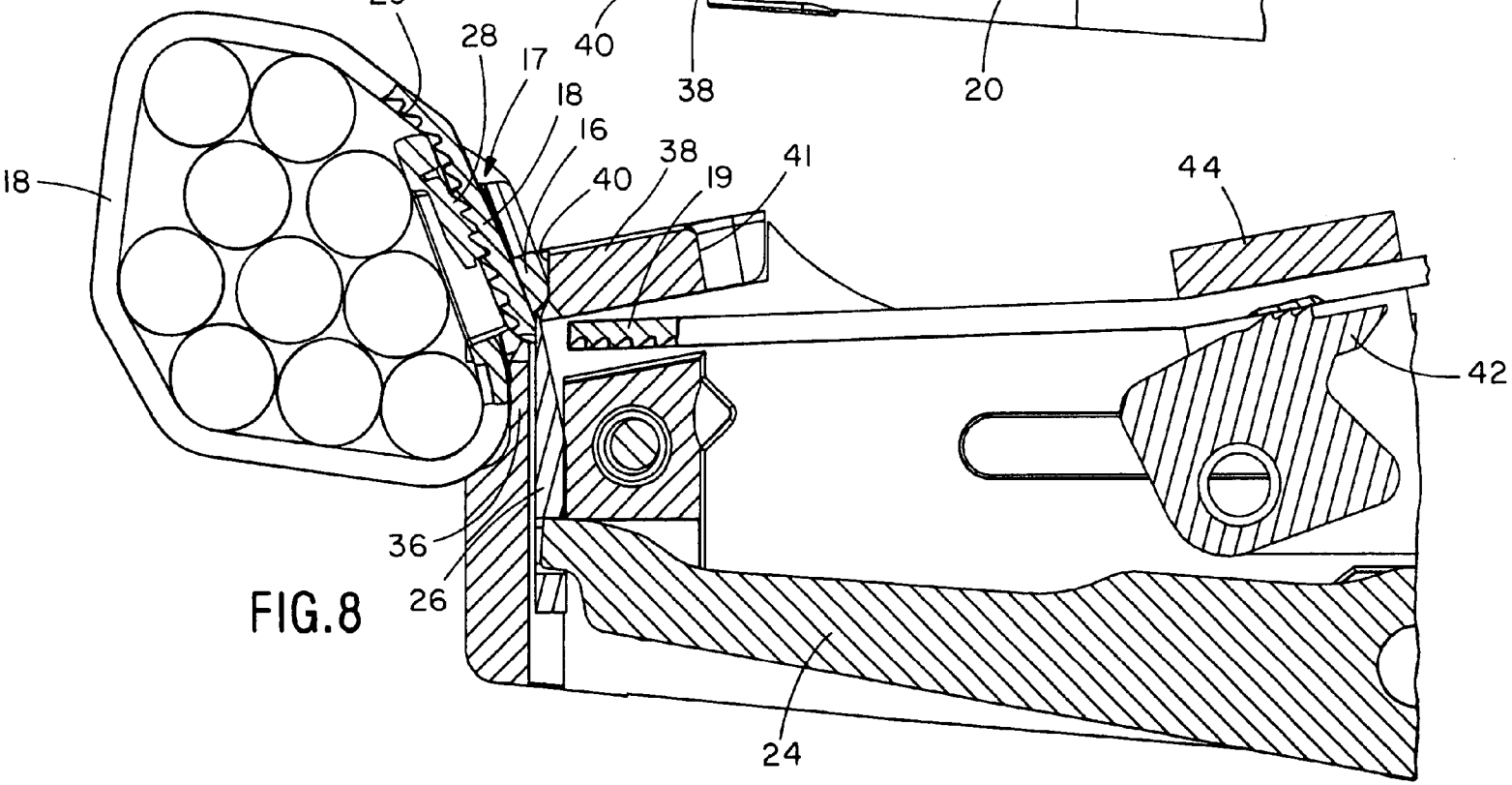
FIG. 8 is an enlarged view of the front portion of the tool of FIG. 7 and the cable tie at the time the tail is being cut by the blade, taken in cross-section across the line 8-8 in FIG. 7.
Figure 9:
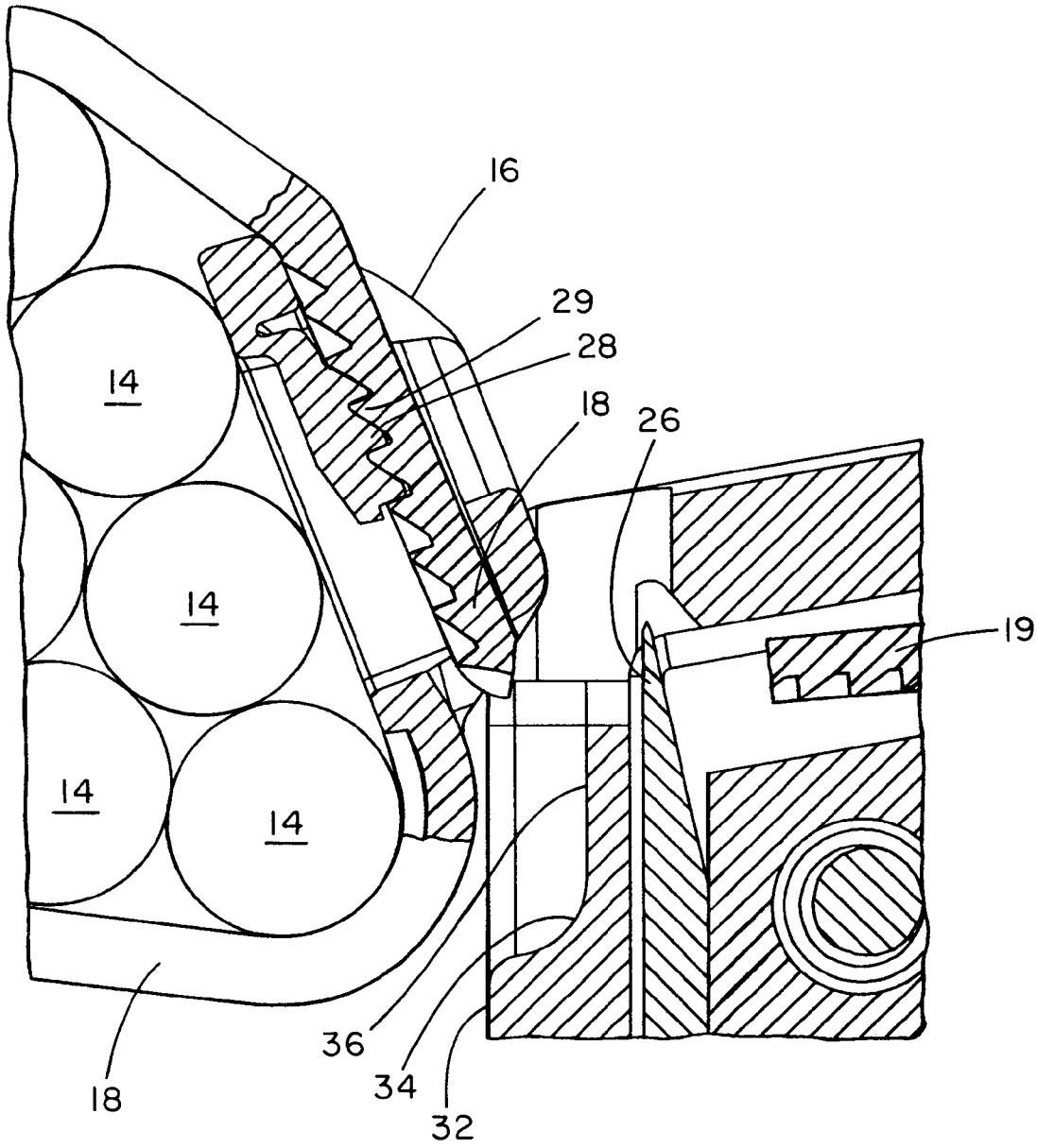
FIG. 9 is a further enlarged view of the front portion of the tool and the tie of FIG. 8 wherein the cable tie is being removed from the tool after severance and the tail has partially receded into the head, portions thereof being shown in section.
Figure 10:
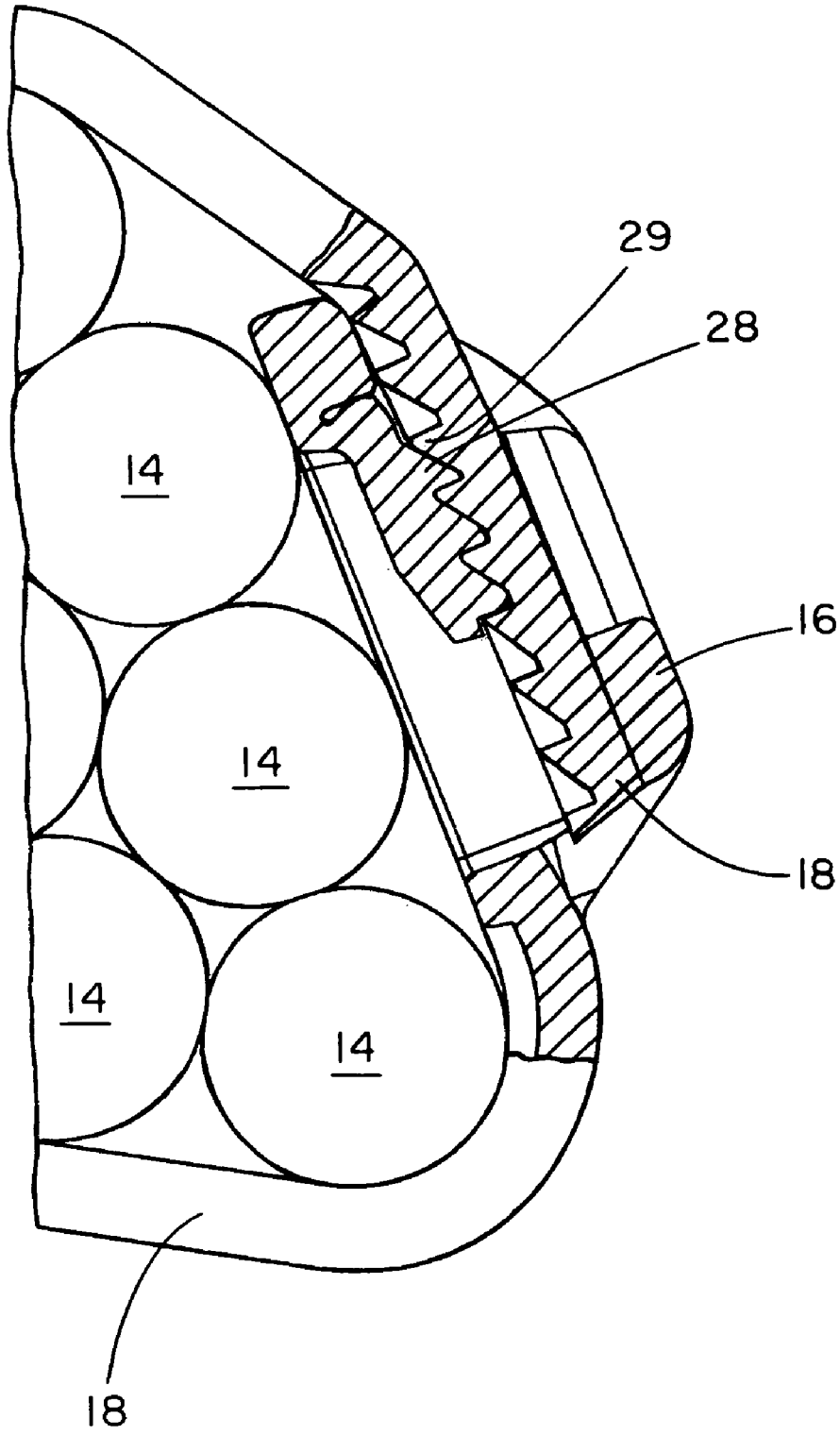
FIG. 10 is a view of the cut cable tie after the tail has receded into the head of the tie, a portion thereof being shown in section.
Figure 11:
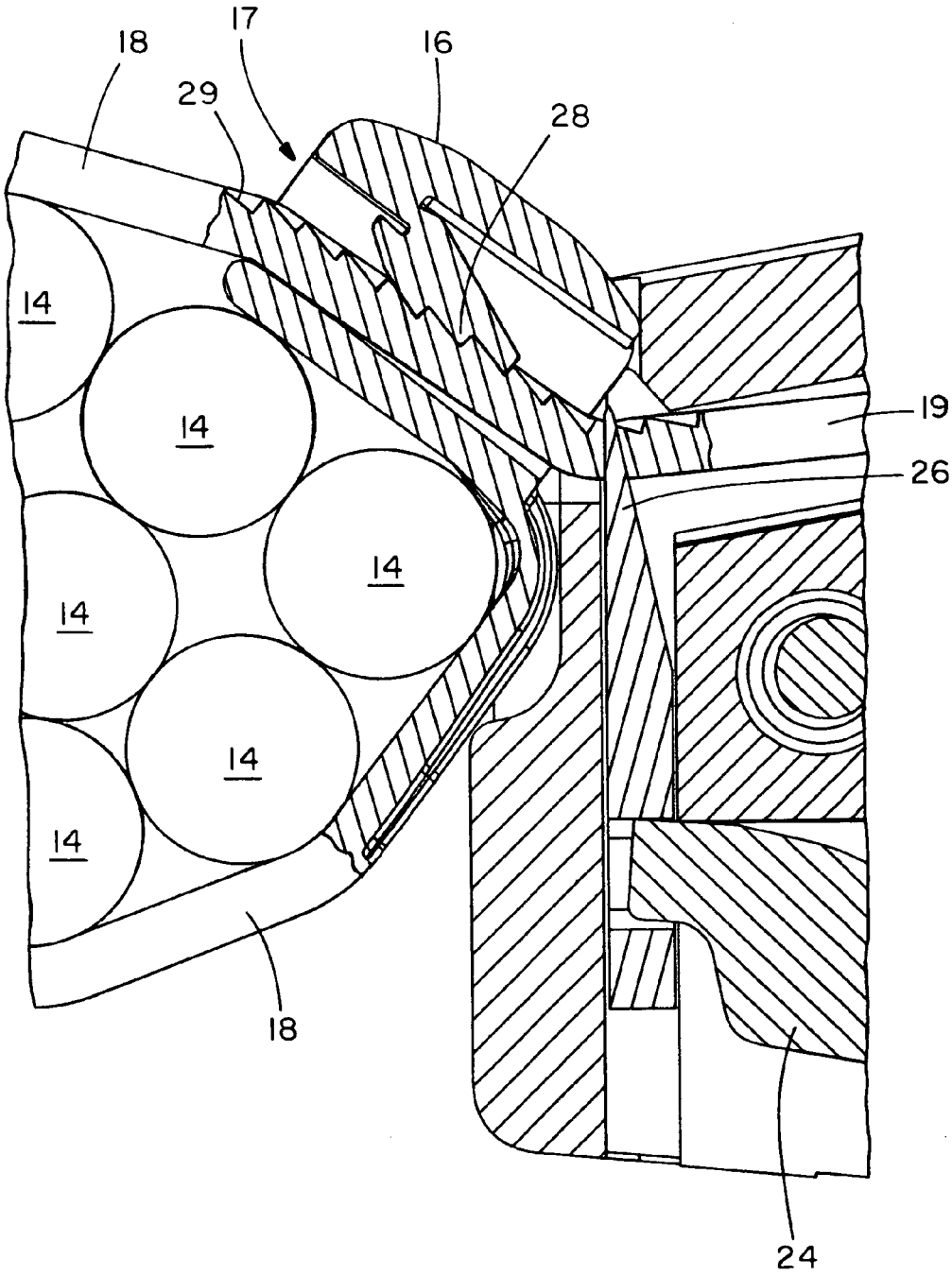
FIG. 11 is a closeup view akin to FIGS. 8 and 9 wherein an alternate in-line cable tie head is shown.
Figure 12:
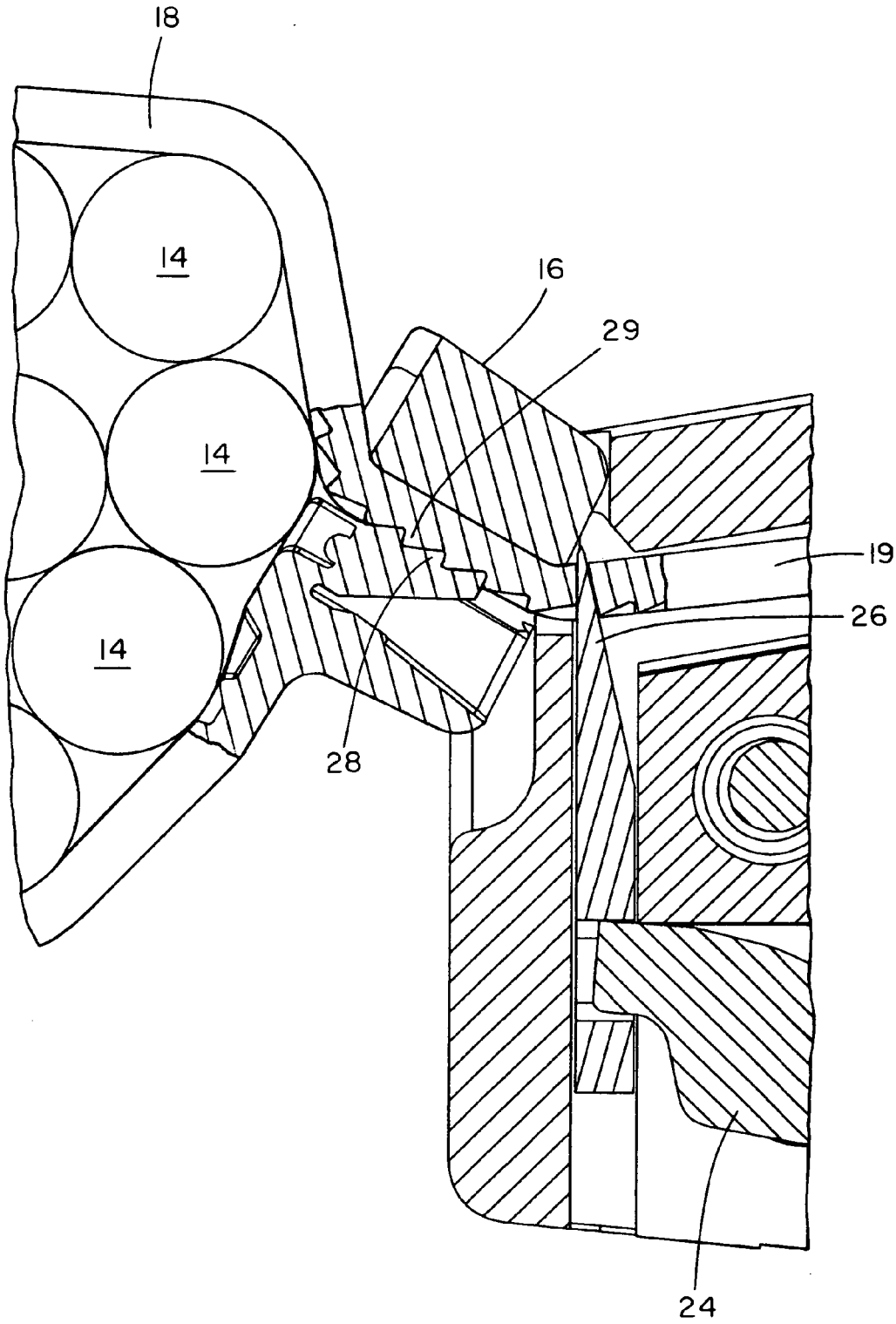
FIG. 12 is a closeup view akin to FIGS. 8 and 9 wherein a second alternate cable tie head is shown.

FIGS. 6-8 depict how the relieved anvil portion 38 and the recessed portion 34 permit the cable tie head portion 16 to be pulled by the tensioning mechanism 22 very near the cutting line of the blade 26. As seen in FIG. 8 in particular, the blade may even preferably pass in front of the anvil portion 38 such that it makes contact or near-contact with the cable tie head portion 16 after passing through and severing the cut-away portion 19 from the remaining tail portion 18. FIG. 9 is an enlarged view wherein the cable tie is being withdrawn from the tool after severance and the tail is "snapping back" into the head under the low-tension force applied to the tail by the compressed bundle, and FIG. 10 is a view of the cut cable tie after the tail has receded into the head of the tie. FIG. 11 shows an embodiment of the invention wherein an alternate in-line cable tie head is depicted, and FIG. 12 shows a non in-line alternate cable tie head in use with an embodiment of the invention.

According to some embodiments of the present invention, it is preferable to limit a predetermined tension applied to a cable tie tale by a tensioning mechanism of the tool before severing of a cable tie tail. The limiting of the predetermined tension prevents undesirably high forces from being applied to cables or other objects within a cable tie loop. For example, in one embodiment a predetermined tension of 18 pounds is the highest desirable tension. In another embodiment a predetermined tension of 10 pounds is the highest desirable tension.

It is easily observed that the invention described herein is not limited to the particular embodiment(s) described above and/or shown in the accompanying figures. Rather, it is anticipated that the inventive blade guard would be applicable to many other tool designs and could achieve the same low-tension flush cut advantages with other tools. Additionally, it is anticipated that the inventive blade guard itself may assume different configurations. By way of example, and not to be construed as limiting in any way, alternative embodiments might include blade guards having an anvil portion that may be a separate piece rather than integrally formed with the front and/or side portions. The scope of the invention is defined by the following claims.

The invention claimed is:

1. A cable tie installation tool for tensioning a cable tie about a plurality of elongated objects and severing an excess portion of said cable tie, said cable tie including a head portion and a tail portion, said tool comprising:

a housing having a blade guard having a front portion and an anvil portion being spaced from the front portion of the blade guard;

a tensioning mechanism operatively supported by said housing for tensioning said cable tie to a predetermined tension setting and retaining said cable tie head portion at least partially against said blade guard; and a severing mechanism including a linearly reciprocating blade for severing said excess portion of said cable tie near said head portion once said cable tie has been placed into said predetermined tension setting by said tensioning mechanism;

wherein said linearly reciprocating blade passes behind said front portion of said blade guard and in front of said anvil portion of said blade guard and said anvil portion having a rear edge for limiting forward travel of the tensioning mechanism.

2. A cable tie installation tool in accordance with claim 1 wherein said tool is manually actuable.

3. A cable tie installation tool in accordance with claim 1 wherein said predetermined tension setting is no more than approximately 18 lbs.

4. A cable tie installation tool in accordance with claim 1 wherein said predetermined tension setting is no more than approximately 10 lbs.

5. A cable tie installation tool in accordance with claim 1 wherein said front portion of said blade guard includes a recessed portion having a spacer portion no more than approximately 0.030 inches thick.

6. A cable tie installation tool in accordance with claim 1 wherein the front portion of the blade guard includes a recessed portion.

7. A cable tie installation tool in accordance with claim 6 wherein the anvil portion and the recessed portion of the blade guard permit the cable tie head to be pulled by the tensioning mechanism near the blade.

8. A blade guard for a cable tie installation tool for tensioning a cable tie about a plurality of elongated objects and severing an excess portion of said cable tie, said cable tie including a head portion and a tail portion, said blade guard comprising:

a front portion;

a recessed portion on said front portion; and an anvil portion having a front end for contacting said cable tie head portion during at least one of said tensioning and said severing, said front end of said anvil portion being generally disposed behind said recessed portion of said front portion.

* * * * *